US012601181B1

(12) United States Patent
Johnson et al.

(10) Patent No.: US 12,601,181 B1
(45) Date of Patent: Apr. 14, 2026

(54) PORTABLE ACCESSIBLE RAMP SYSTEM

(71) Applicants: Katheryn Johnson, Littleton, CO (US); Michael D'Ippolito, Colorado Springs, CO (US)

(72) Inventors: Katheryn Johnson, Littleton, CO (US); Michael D'Ippolito, Colorado Springs, CO (US)

( * ) Notice: Subject to any disclaimer, the term of this patent is extended or adjusted under 35 U.S.C. 154(b) by 0 days.

(21) Appl. No.: 19/247,286

(22) Filed: Jun. 24, 2025

(51) Int. Cl.
*E04F 11/00* (2006.01)

(52) U.S. Cl.
CPC ..... *E04F 11/002* (2013.01); *E04F 2011/005* (2013.01); *E04F 2011/007* (2013.01)

(58) Field of Classification Search
None
See application file for complete search history.

(56) References Cited

U.S. PATENT DOCUMENTS 3,328,818 A * 7/1967 Melcher ..... B65G 69/30 52/309.16
3,517,791 A * 6/1970 Miles ..... B60P 1/43 193/41
3,688,803 A * 9/1972 Pavia ..... F16L 9/02 138/173
5,341,533 A * 8/1994 Seitz ..... E01C 11/222 254/88
5,347,672 A * 9/1994 Everard ..... B60P 1/43 160/133
5,815,870 A * 10/1998 Deutch ..... B65G 69/30 52/180
6,385,923 B1 5/2002 Pelosi, Jr.
6,427,403 B1 8/2002 Tambakis
6,430,769 B1 * 8/2002 Allen ..... B65G 69/30 16/376
7,950,094 B2 * 5/2011 Bailie ..... B60P 1/43 14/69.5
8,074,314 B2 * 12/2011 Lucht ..... B65G 69/30 14/69.5
8,522,921 B2 9/2013 Stanaland
8,813,289 B1 * 8/2014 Clark ..... E04F 11/002 14/69.5
8,844,083 B2 9/2014 McGivern
(Continued)

FOREIGN PATENT DOCUMENTS

ES 1305745 U * 2/2024 ..... E04F 11/002
JP 2003213900 A * 7/2003 ..... E04F 11/002

*Primary Examiner* — Christopher J Sebesta
*Assistant Examiner* — Katherine J Chu
(74) *Attorney, Agent, or Firm* — Leyendecker & Lemire LLC

(57) ABSTRACT

An accessible ramp system that comprises lightweight platforms comprised of plastic and/or recycled plastic. To provide strength and rigidity to the platform, a radially extending configuration of reinforcing stringers are used on the bottom side thereof. Each stringer extends from the center of the platform wherein an optional center support leg can be received. The thickness of each stringer generally orthogonal to the platform's flat surface tapers from the center where it is thickest to the perimeter of the platform where it is the thinnest. The radially extending stringer are joined together by a plurality of generally circumferentially extending cross stringers. The stringer web, inspired by the giant Victoria water lily, acts to substantially stiffen the platform while minimizing weight.

12 Claims, 9 Drawing Sheets

(56) References Cited

U.S. PATENT DOCUMENTS

| | | | | |
|---|---|---|---|---|
| 8,959,693 | B2 | 2/2015 | Pohlman | |
| 9,644,375 | B2 | 5/2017 | Stanaland | |
| 9,775,326 | B1 * | 10/2017 | MacNeil | A01K 29/00 |
| 10,156,045 | B2 | 12/2018 | Penland | |
| 10,288,213 | B1 * | 5/2019 | Harper | B65G 69/30 |
| 10,676,937 | B2 * | 6/2020 | Winter | E04F 11/002 |
| 10,836,592 | B1 | 11/2020 | Arnold | |
| 11,553,693 | B2 | 1/2023 | Sarver | |
| 11,585,096 | B2 * | 2/2023 | Jakubowski | E04F 11/002 |
| 11,788,299 | B2 * | 10/2023 | Bonner | E04F 11/002 14/69.5 |
| 2009/0255066 | A1 | 10/2009 | Brock | |
| 2012/0047830 | A1 * | 3/2012 | Phuly | E02B 17/025 52/294 |
| 2014/0023811 | A1 | 1/2014 | Kuo | |
| 2014/0150188 | A1 * | 6/2014 | Allen | E04F 11/1865 256/65.03 |
| 2018/0216349 | A1 | 8/2018 | Whiteley | |
| 2019/0282417 | A1 | 9/2019 | Walker | |
| 2019/0283986 | A1 * | 9/2019 | Morrish | E04F 11/002 |
| 2021/0131041 | A1 | 5/2021 | Penland, Jr. | |
| 2022/0381036 | A1 | 12/2022 | Suggate | |
| 2022/0412097 | A1 | 12/2022 | Cociuban | |
| 2023/0193633 | A1 | 6/2023 | Grifhorst | |
| 2023/0235565 | A1 | 7/2023 | Matsushita | |
| 2025/0042679 | A1 * | 2/2025 | Krolski | B65G 69/30 |

* cited by examiner

PORTABLE ACCESSIBLE RAMP SYSTEM

BACKGROUND

Federal, state and local laws typically require most public building and commercial facilities be accessible to those unable to use stairs. This typically comprises a ramp that gradually and gently rises over its length permitting persons in wheel chairs as well as other challenged persons to access the elevated location. As per the ADA, these ramps may not have a slope greater than 1:12 and must be 36" wide. Further, a level landing must be provided no more than every 30 feet. Handrails are required if the total rise exceeds 6".

Often permanent systems such as ramped sidewalks and deck ways supported by permanent fixed posts are installed space permitting; however, in many instances, a permanent system is neither feasible nor practicable. For instance, in older buildings, especially historic structures, a permanent solution may require the unacceptable alteration of the building's historic appearance or its structure. In other instances, the use may be temporary, such that the cost and eventual demolition is not economically feasible.

Portable ramp systems are known that can be customized and installed in desired locations. They typically comprise metal platforms, typically aluminum for lighter weight, that are connected together in a desired configuration. They are supported legs that have wide feet that rest on an underlying ground surface. Handrails are also provided that can be secured to the platforms. Despite being made largely of aluminum, these systems can be very heavy requiring a significant amount of manpower to assemble and disassembly them, and as such, they are only nominally portable largely requiring transport in medium to heavy duty trucks.

BRIEF OF THE DRAWINGS

DETAILED DESCRIPTION OF THE PRESENT INVENTION

Overview

Figure 1:
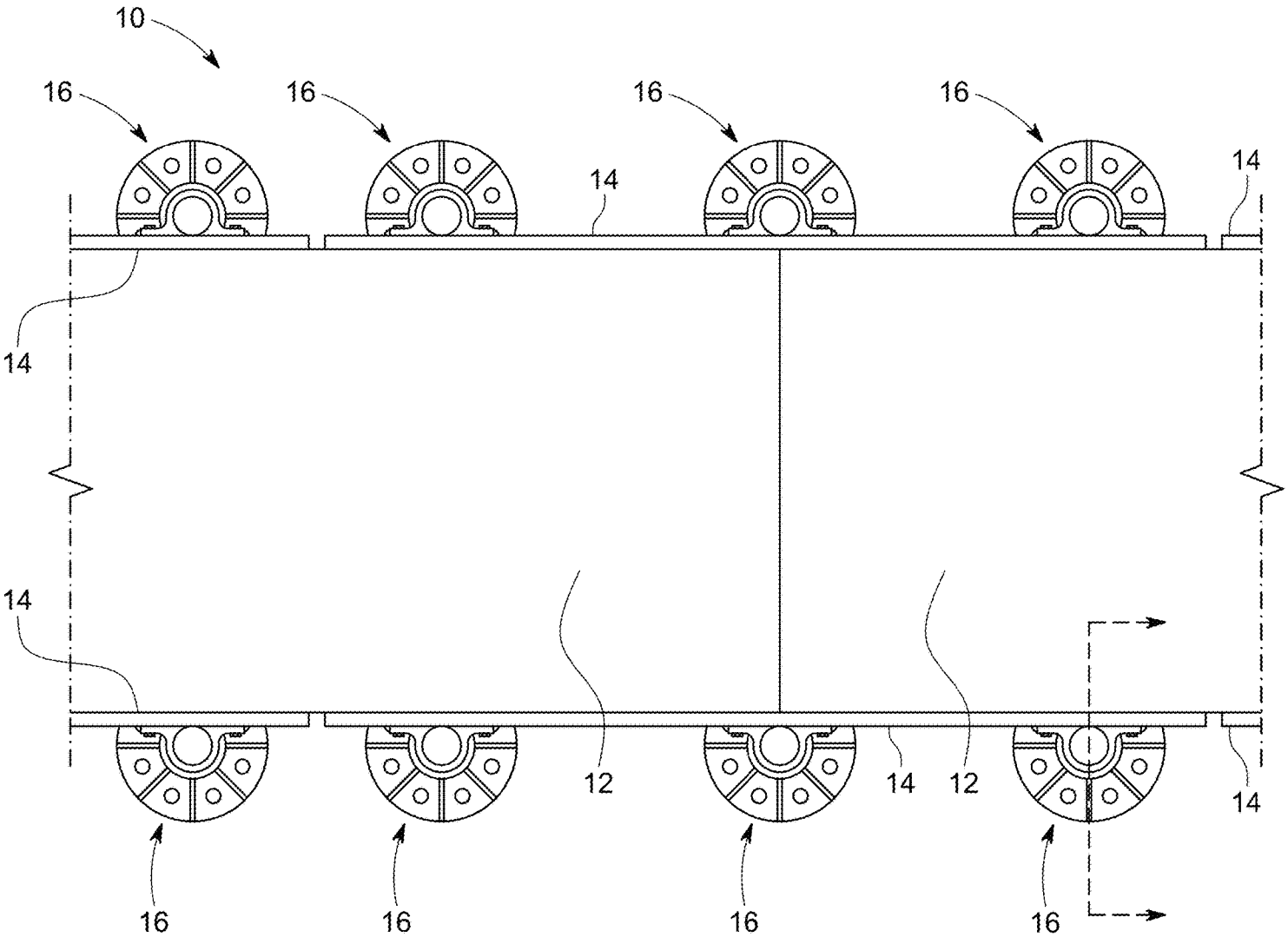
FIG. 1 is a top view of a section of a portable ramp system according to embodiment of the present invention.

Embodiments of the present invention comprise an accessible ramp system that comprises lightweight platforms comprised primarily of plastic, and more particularly, recycled plastic. To provide strength and rigidity to the platform, a radially extending configuration of reinforcing stringers are used on the bottom side thereof. Each stringer extends from the center hub of the platform wherein a center support leg can be received in certain embodiments. The thickness of each stringer generally orthogonal to the platform floor's flat upper surface tapers from its intersection with the center hub where it is thickest to proximate the perimeter of the platform where it melds into the bottom surface of the floor. The radially extending stringers are joined together by a plurality of generally circumferentially extending cross stringers. The stringer web, comprising both radial and cross stringers, is inspired by the giant Victoria water lily, and acts to substantially stiffen the platform while minimizing the overall weight of the platform. By employing the stringer web and by incorporating a center support leg assembly in addition to the customary side support legs in some embodiments, the overall weight of the platform and consequently the entire system can be reduced compared to prior art aluminum platforms and systems.

The platforms include perimeter sidewalls that include an array of sidewall through-holes distributed there on. These holes permit platforms to be joined together and permit L-shaped L-brackets, including the required side bumper portions, to be attached thereto. The L-brackets are typically comprised of aluminum and also include a plurality of L-bracket through-holes distributed thereon. The L-bracket through-holes permit the brackets to attach to the platforms including splicing two platforms together, as well as, provide for the attachment of the side leg assemblies. As can be appreciated posts for handrails are also typically attached to the generally vertical portions of the L-brackets through the fastener holes provided in the L-brackets.

Because of the much lighter nature of the platforms and brackets compared to prior art systems and the incorporation of a center leg assembly in some embodiments, the legs themselves can be made lighter than prior art legs. Both the side leg assembly and center leg assembly, as applicable, comprise nested telescoping tubes that can be adjusted to various lengths using commonly known adjusting mechanisms. Further, the side leg assemblies can be adjusted to ensure they are substantially vertical despite the angle of the platform(s). The side leg assemblies further include a wide plastic side footer with reinforcing ribs that includes a partially spherical recess wherein a ball end of the shaft portion of the assembly can be received. Accordingly, the side leg assemblies can be securely footed on ground surfaces that are a bit off camber.

Advantageously, embodiments of the accessible ramp system with plastic platforms are substantially lighter than traditional prior art systems facilitating easier transportation of disassembled components, and easier assembly and disassembly at a desired site using a small crew.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive, rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front, lateral, outwardly, and upwardly are relative to each other and are dependent on the specific orientation of an applicable element or article, and are used accordingly to aid in the description of the various embodiments and are not necessarily intended to be construed as limiting.

Unless otherwise indicated or dictated by context, the terms "generally", "approximately" and "about" mean+−20% and/or wherein the percentage deviation is not quantifiable, the terms mean for the most part as this would be understood by the relevant person of ordinary skill in the art. Unless otherwise indicated or dictated by context, the term "substantially" means+−10%.

Embodiments of a Plastic Accessible Ramp System

Figure 2:
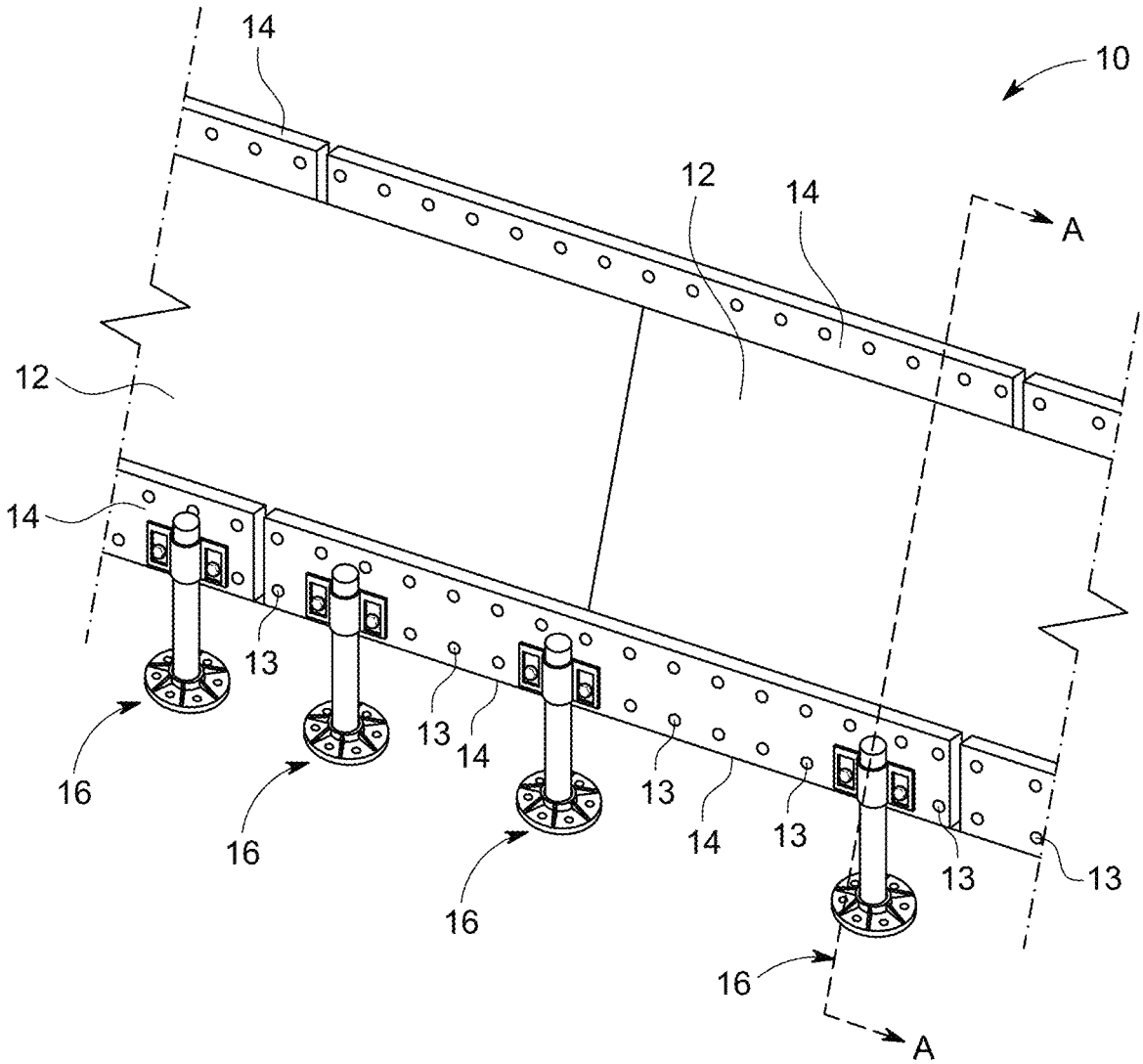
FIG. 2 is a perspective top view of a section of a portable ramp system according to embodiments of the present invention.

FIGS. 1 & 2 show a portion of an embodiment of an assembled ramp 10. Of particular note, handrails would typically be attached to the L-brackets 14 along the edges of the platform sections 12, but they have been omitted from these views for purposes of clarity. In the FIG. 2 view, only the side leg assemblies 16 on one side of the ramp portion can be seen.

Figure 3:
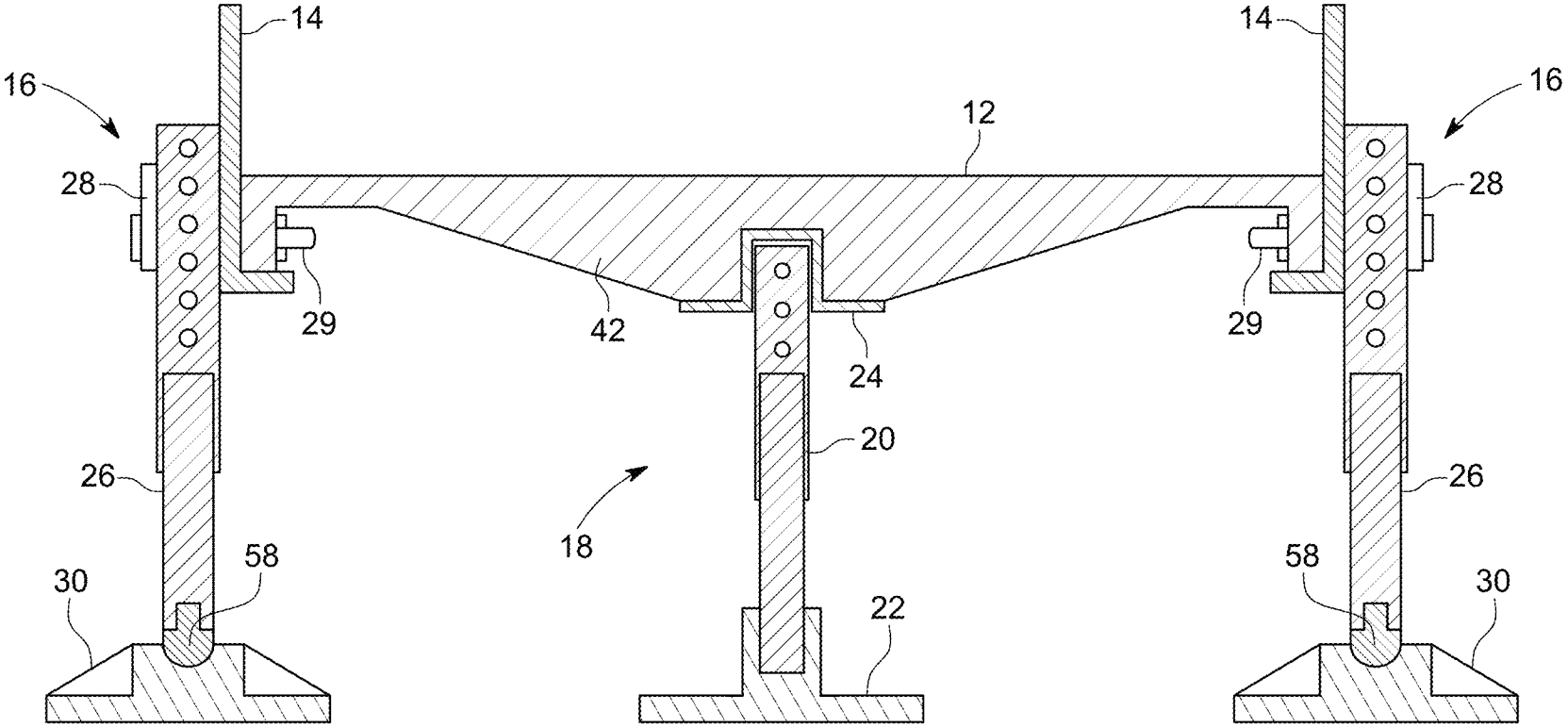
FIG. 3 is a cross-sectional view long line A-A of FIG. 2 according to embodiments of the present invention.
Figure 4:
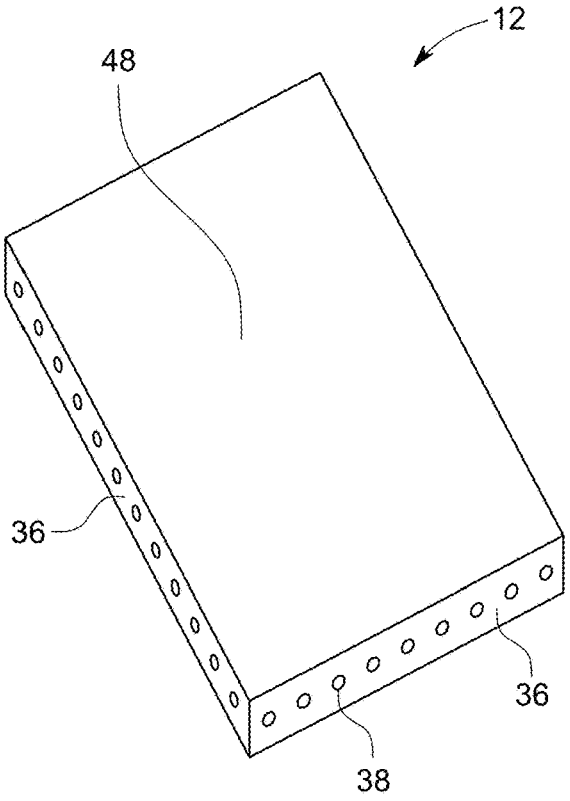
FIG. 4 is a perspective top view of a first platform section according to embodiments embodiment of the platform.
Figure 5:
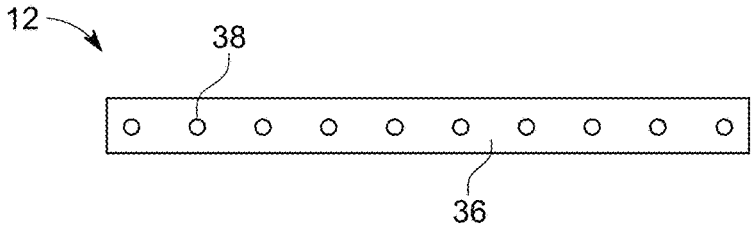
FIG. 5 is a side view of a platform section according to embodiments embodiment of the platform.
Figure 6:
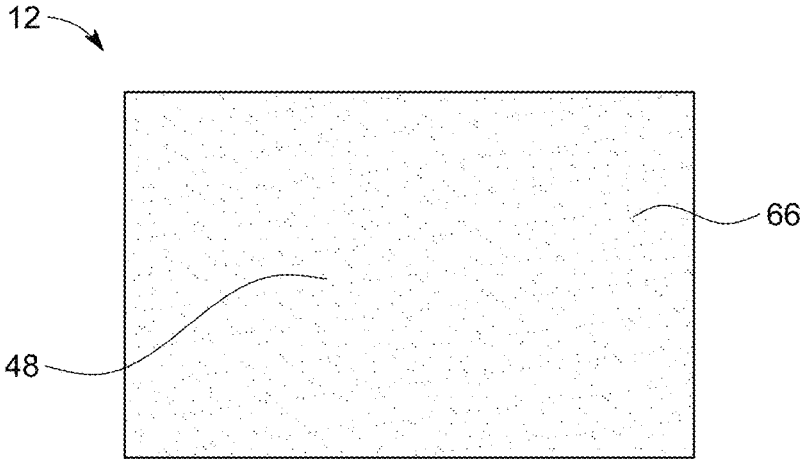
FIG. 6 is a top view of a platform section according embodiments embodiment of the platform.

The assembled ramp portion as illustrated comprises platform sections 12 that are bolted together and further joined through a plurality of L-brackets 14. The L-brackets also incorporate elongated generally vertically extending arms that form bumpers along the edges of the platform sections. Typically, the bumpers are at least 4" in height over the top surfaces of the platform sections as is often required by state and federal regulations. The side leg assemblies 16 are attached to the outside of the L-brackets on both sides of the platform sections. Further, although not visible in FIGS. 1 & 2, center leg assemblies 18, as shown in the cross section of FIG. 3, are provided that couple to the center of each of the platform sections.

Two embodiments of the platform section 12 are shown in FIGS. 4-8. The typical platform section is three feet wide and four feet long and molded as a single piece from a reinforced or unreinforced plastic. However, to account for the myriad of different configurations, many different sizes are known. Overall, both embodiments have substantially flat top surfaces that can include a molded in texture to enhance grip during use. The texture can comprise a specific pattern or can be the result of depositing silica particles 66 or other similar materials on the inside surface of the mold during fabrication for transfer to the top surface. Although the specifications can vary depending on many factors, such as size, and the plastic material used, the floor 48, which includes the top surface, is about 0.20-0.63" thick.

In some embodiments, the platform, including sidewalls 36 that extend around all four sides, has an overall thickness of about 2". The sidewalls include a plurality of sidewall though-holes 38 that extend linearly along its length that permit the platform sections to be attached to each other, and to be secured to the L-brackets 14. The horizontal thickness of the sidewalls can vary, but are typically about 0.25-0.63".

Figure 7:
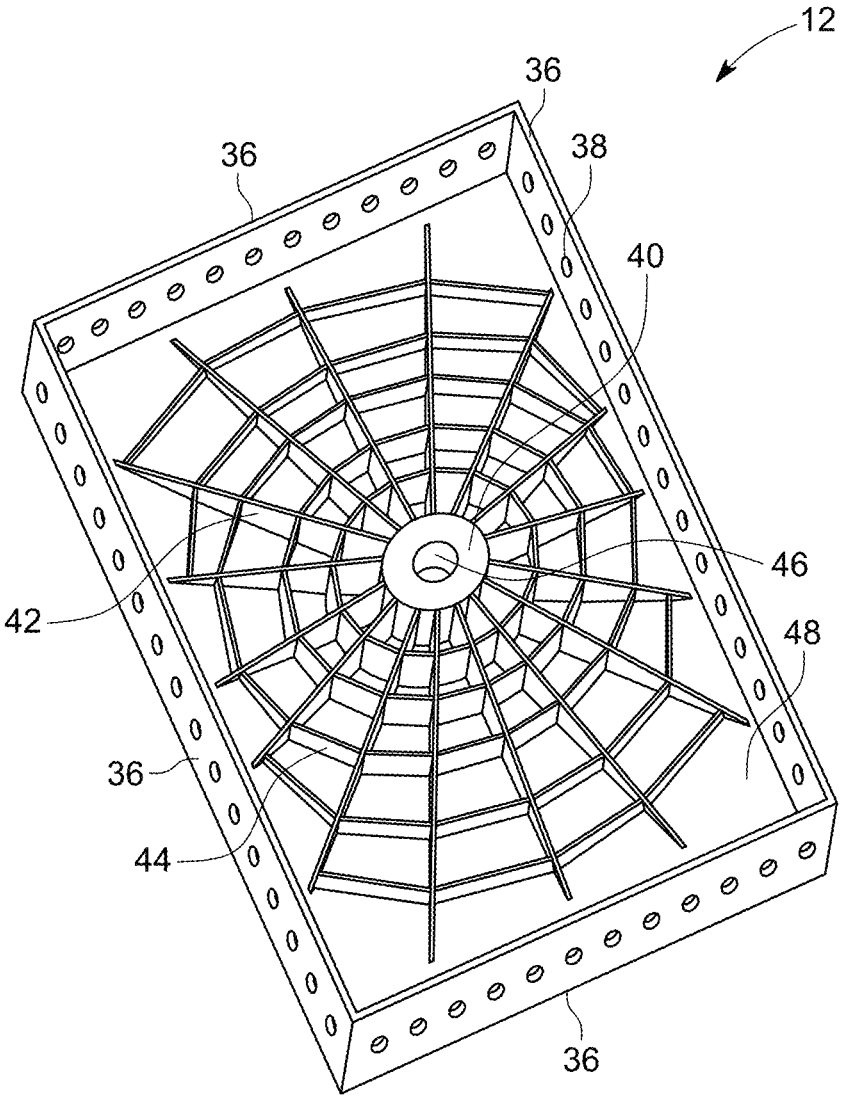
FIG. 7 is a perspective bottom view of a platform section according to a first embodiment of the platform.
Figure 8:
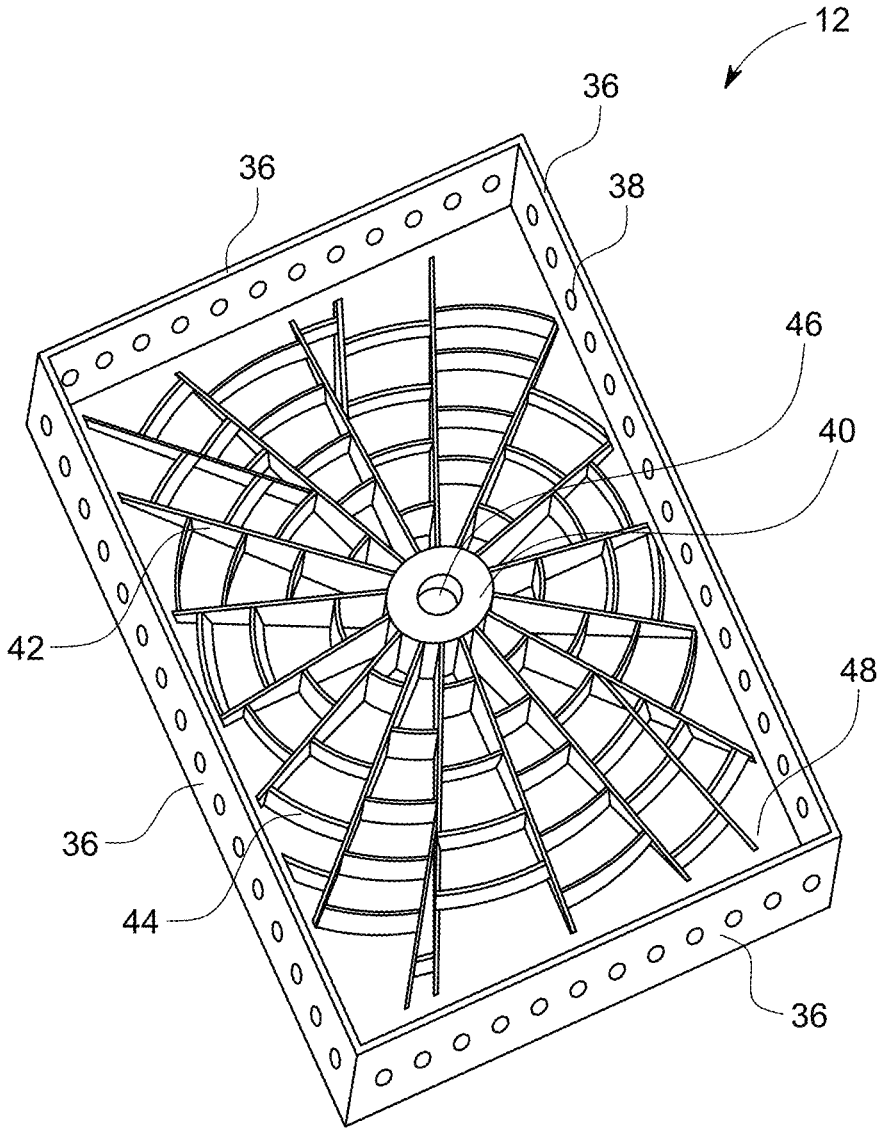
FIG. 8 is a perspective bottom view of a platform section according to a second embodiment of the platform.

With reference to FIGS. 7 & 8, both embodiments of the platform section 12 include a plurality of radial stringers 42 that emanate a center hub 40 and are spaced distributed around the entire circumference of the hub. Cross-bracing stringers 44 that extend between the radial stringers at various locations radially outwardly from the hub are also provided. The number of radial and cross bracing stringers, as well as, their dimensions can vary depending on the size of the platform sections, the plastic material used in the platform's construction, and other factors. However, in at least some embodiments the vertical thickness of each radial stringer is typically similar to the overall thickness of the platform section minus the thickness of the floor 48 where the radial stringer interfaces with the center hub. The vertical thickness of the radial stringers then tapers as the stringers extend towards the sidewalls 36, and typically meld with the floor and terminate about 1-2" from the inside surface of the sidewalls so that the stringers do not interfere with the sidewall through-holes 38 and fasteners used therein.

The number of cross-bracing stringers 44 and their configuration varies as depending on similar factors pertaining to the radial stringers. Generally, the vertical thickness of the stringer is similar or less than the thickness of the radial stringers 42 at the location with which it interfaces therewith. Typically, multiple cross-bracing stringers are spaced between adjacent radial stringers to stiffen and strengthen the platform.

The center hub 40 is located at the center of a typical platform section 12 and is configured to receive a top end 24 of a center leg assembly 18 therein. In some platform embodiments where the platform section is considerably longer than it is wide, there may be two center hubs provided with radial stringers extending outwardly from each with some of the radial stringers in between the two hubs extending from one hub to the other. The center hub is typically about the same thickness as the platforms overall thickness and includes a cylindrical center receptacle 46 that extends upwardly into the hub about 1.25-1.75". The top end cap 24 of an associated center leg assembly is received in the cavity when the system is assembled and deployed.

As indicated above, at least two embodiments of the reinforcing stringer web (comprising the interconnected radial and cross-bracing stringers) are contemplated as illustrated herein. The embodiment shown in FIG. 8 comprises the use of radial and cross-bracing stringers that are less uniform and ordered than the embodiment of FIG. 7. These stringers are generally representative of the stringers and associated stringer web found on the giant Victoria water lily. The embodiment of FIG. 7 comprises substantially linear radial and cross-bracing stringers 42 & 44 wherein the radial stringers are substantially uniformly distributed about the associated center hub 40 and all extend outwardly in a straight line without any jogs or turns. The cross-bracing stringers are also linear and distributed in a regular pattern between adjacent radial stringers.

As also indicated above, the platform sections 12 are typically comprised of plastic. In some variations the plastics include a high percentage of recycled plastics. In yet other variations, the plastic materials can be reinforced with a variety of materials including, but not limited to, plant fiber (hemp, wheat, corn, sugar cane, etc . . . ), wood pulp, and short strand fiberglass and/or carbon fiber. Variations are also known wherein elongated aluminum (or other metallic) channel, tubing or similar are strategically molded into, or added and attached to, the primarily plastic platform to provide additional strength and reinforcement. The type of plastic can vary with differing designs and the dimensions and thickness of the various elements of the platform sections can be varied to accommodate the differing properties of the various plastics, reinforced and unreinforced. The platform section can be made using any suitable process such as, but not limited to, injection molding and compression molding. As discussed below, other parts can be made from similar plastic materials.

Variations of the platform can be configured such that a center leg is not required to support the platform. In these platforms, the center hub need not include a receptacle to receive a center leg and generally, the thickness of the stringers, such as thickness, are increased to handle the increased unsupported spans. Platforms that do not require the center leg can also include an aluminum or other metal substructure that is either attached to the plastic portion of the platform after molding or molded into the plastic portion. Further, reinforcing materials, such as discussed above, can be utilized to provide additional strength.

Figure 12:
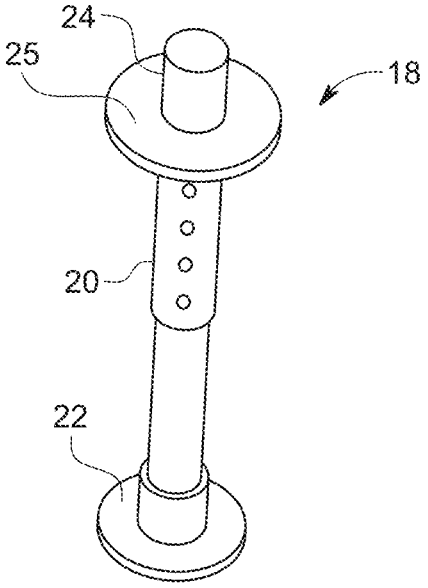
FIG. 12 is a perspective view of a center leg assembly according to an embodiment of the present invention.

The center leg assembly 18 is shown in FIG. 12. It typically comprises a center length-adjustable leg 20 wherein an inner tube or shaft can telescope relative to an outer tube and be fixed in a plurality of positions to set an overall length. The inner and outer tubes can be made of any suitable material but most often comprise aluminum or steel. Further, any suitable mechanism to secure the telescoping tubes at a desired length can be used, but in some variations, outwardly sprung pins coupled with the inner tube interface with receiving bores on the outer tube to secure the shaft assembly at the desired length.

The bottom end of the center leg 20 fits into a receptacle in a center footer 22 that interfaces with the ground to provide a stable base over which the load incident on the center leg assembly 18 it transferred over an area of the underlying ground surface. The center footer can be comprised of any suitable material, such as aluminum or steel. Further in some embodiments, the footer can be comprised of similar plastic or recycled plastic as is used in the platform sections. A plastic center footer would likely have design similar characteristics as the side footer 30 discussed in more detail below as is associated with the side leg assemblies 16.

The top end cap 24 of the center leg assembly 18 comprises a cylindrical plug that is removably received in the center receptacle 46 of the center hub 40. A circular flange 25 typically extends outwardly from the base of the cap with its top surface being received against the bottom surface of the center hub 40 to help receive and transfer load incident on the platform section 12 to and through the center leg assembly 18.

Figure 9:
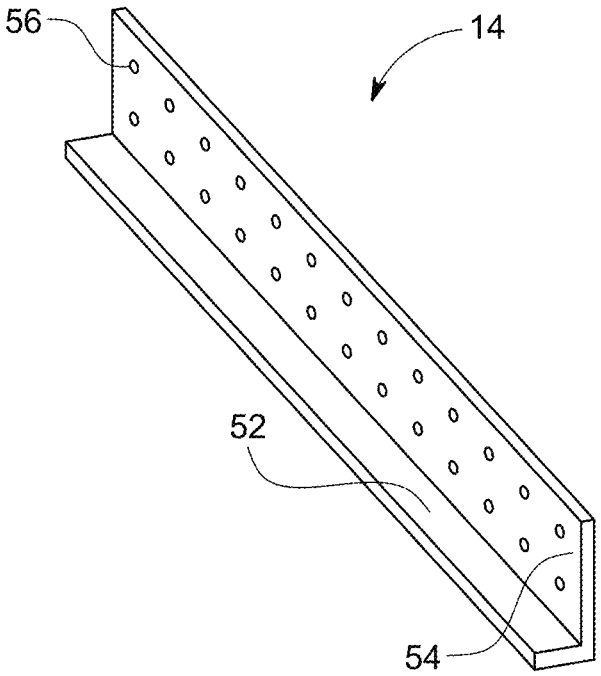
FIG. 9 is a perspective view of an L-bracket support according to an embodiment thereof.

FIG. 9 illustrates an L-bracket 14. The L-brackets line left and right sides of each platform section 12 and provide edge support for the platforms with the sidewalls of the platform resting on the horizontal leg (or first L-leg) 52 of the bracket. Further, the vertical leg (or second L-leg) 54 of the L-bracket extends upwardly a sufficient distance to form ADA required bumpers. The vertical leg also includes an array of L-bracket through holes distributed on it. As shown in FIG. 3, the through holes 56 allow both the attachment of the L-brackets to the sides 36 of the platforms 12 by aligning the through holes in each 56 & 38 and securing bolts 29 therein, and the attachment of the angle and length adjustable side leg assemblies 16 thereto.

The system is designed such that L-brackets 14 will span across the left and right side of adjacent platforms meet to join them together. This is best shown in FIGS. 1 & 2 wherein two platform sections 12 are butted up against each other and on both the right and the left side of the interface with left and right L-brackets spanning across the interface and being bolted to both platforms. The bolt heads 13 are shown in FIG. 2. Effectively, load from one platform is at least partially transferred to the other platform through the relatively stiff and strong L-brackets. Further, the respective sides of the platforms at the interface can be bolted together through the aligned bolt holes in each side wall 36.

The L-brackets 14 can be made of any suitable material but because of its high strength and relatively lightweight channel made of aluminum alloy, such as 6061-T6 or 6063-T4, is typically used. Variations of the L-brackets are contemplated such as one that comprises a fiberglass reinforced plastic with a high recycled plastic content.

Figure 10:
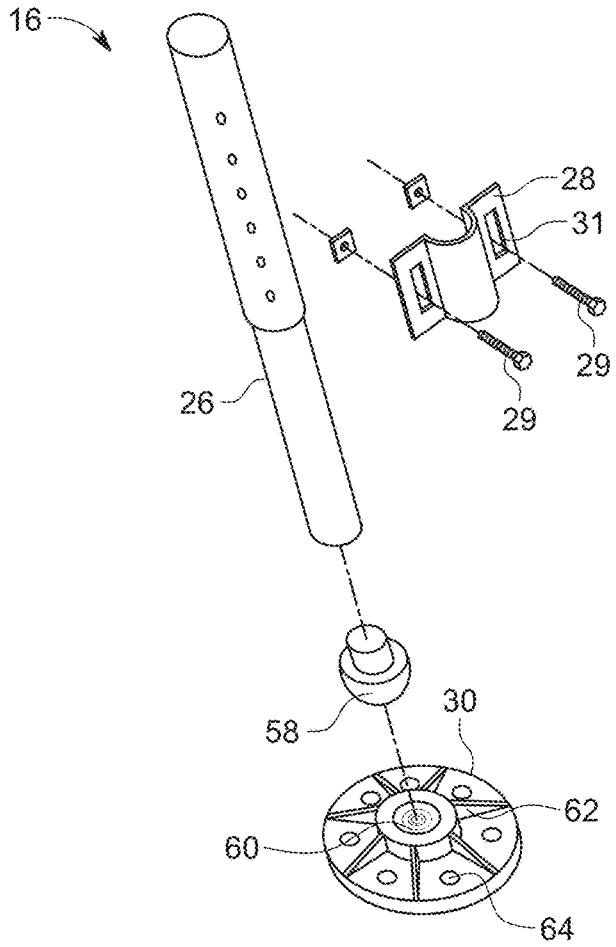
FIG. 10 is a perspective exploded view of a side leg assembly according to an embodiment of the present invention.
Figure 11:
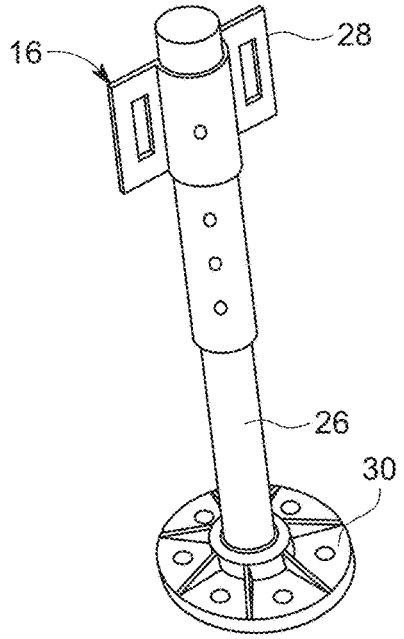
FIG. 11 is a perspective view of a side leg assembly according to an embodiment of the present invention.

FIGS. 10 & 11 are illustrations of a side leg assembly 16. As can be appreciated a significant number of side leg assemblies are used in the construction of a ramp system installation with at least a pair and in many instances three or more side leg assemblies supporting each L-bracket 14 on each side of a platform 12. As can further be appreciated, by using more side leg assemblies (i.e. reducing the spacing therebetween), the load on anyone side leg assembly is reduced, permitting assemblies that are lighter weight to be used. This can result in easier assembly and transport of the leg assemblies by a person to and from a transport truck, as well as, make the construction of the leg assemblies more economical.

As shown, a typical side leg assembly 16 comprises a pair of telescoping tubes that form side length-adjustable leg 26 with the length being adjustable in a similar manner as described for the center length-adjustable leg 20 above. The side length-adjustable leg terminates at a partially spherical end insert 58 that is configured to be received in partially spherical receptacle in a center hub 60 of a plastic side footer 30 permitting the angle of the leg to vary off of vertical while allowing the base of the footer to be firmly planted against the underlying ground surface.

The upper tube section of the side length-adjustable leg 26 is clamped into an angularly-adjustable mounting bracket 28. The style of brackets can vary but as shown the bracket includes opposing elongated bolt holes 31 that receive bolts 29 therethrough. The bolts are also received in the through holes 56 of the associated L-bracket 14 to secure the side leg assembly 16 to the L-bracket at a desired angle. The pivoting nature of the connection in conjunction with the aforementioned partially spherical base connection allow the angle of the side leg assemblies to be adjusted as is necessary to ensure the most stable and secure footing on the ground surface as is reasonably possible.

The side footer 30 is typically comprised of a similar material as the platform sections 12 and also comprises a web of stringers 62 that extend radially from the center hub 60. The radial stringers taper in height from the center hub to the outer perimeter of the footer. The base of the footer includes a plurality of distributed holes 64 through which stakes can be driven to secure the footer to the underlying ground surface as applicable.

Referring back to FIGS. 1-3, each L-bracket 14, which can typically span lengths of 3-5', includes at least two side leg assemblies 16 typically located generally proximate each of the ends of an L-bracket; however, wherein an L-bracket spans two platform sections 12 as shown, an additional side leg assembly is typically provided close to or at the intersection of the two platform section ends. This construction facilitates the transfer of the load from one section to the next adjoining section through the L-brackets. As can be appreciated the actual locations of the side leg assemblies along the length of any particular L-bracket can vary as necessary to ensure the best contact of the assembly with the underlying ground surface.

As is shown in the cross-sectional view of FIG. 3, the sides of each platform 12 are supported by the L brackets 14 on which the edges of the platform sections rest on the horizontal legs of the brackets. The brackets are supported by side leg assemblies 26 that are typically attached with bolts 29 thereto. At least one center leg assembly 18 is coupled to each platform section at center hub 46 along the left to right centerline of each section.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention For instance, while the system is discussed herein comprises two platform sections joined together, deployed systems can and typically comprise many more platform sections to create a complete ramp. Further, although the platform sections illustrated herein are shown as being rectangular, other sections constructed of similar materials and design parameters are contemplated. For instance, sections can be provided that are tapered to provide a smooth transition between the ramp and the ground. While sections are typically four feet wide, the length of the sections can vary such that sections of different lengths may be utilized to design a ramp system to the configuration of an installation site. As mentioned, sections of a certain length, such as greater than 6' may be constructed with two or more center hubs to receive two or more center legs to support the platform. For ramp systems configured with landings, four sections can be bolted together with each section being supported in the center by a center leg assembly and along two edges by side leg assemblies.

The configurations of the center and leg assemblies can vary substantially from the embodiments described herein. For instance, the length adjustable legs and the means of adjusting length can vary from the nested telescoping tubes described herein. Essentially, any structure that can support the weight of the platforms and is length adjustable can be employed, such as internally threaded shaft that receives a screw shaft. The side leg assembly embodiment described herein uses an angularly-adjustable mounting bracket comprising a clamp to secure the assembly to the L-bracket, but the design of the bracket can comprise any configuration that can both transfer the weight between the leg assembly and the L-bracket as well as permit angular adjustment of the leg assembly relative to the L-bracket. While the described embodiments use plastic footers as the base of the leg assemblies, it is appreciated that footers of other designs and configurations can also be used.

The L-brackets typically comprise aluminum alloy L-channel but variations can be comprised of other metals and/or reinforced plastics. In deployed ramp systems, railings are attached to the vertical arms of the L-brackets. The construction of the railings can vary but typically comprise lightweight but sufficiently strong materials. For instance, the railing posts can comprise aluminum alloy or reinforced plastic tubes that are bolted to the L-brackets.

We claim:

1. A portable accessible ramp system comprising:

at least first and second plastic one-piece rectangular platforms, each platform comprising (A) left, right, front, and back edges, and a floor having a substantially flat upper surface, (B) a center hub located in a center of the platform on the bottom side of the floor, the center hub having a first thickness and including a downwardly-facing center receptacle configured to receive a center leg assembly, (C) a plurality of radial stringers spaced and distributed around the center hub and extending radially outwardly therefrom, each radial stringer gradually tapering in thickness from the first thickness at an intersection with the center hub to a second thickness at an end proximate the respective left, right, front or back edge wherein the second thickness is much less than the first thickness, and (D) left, right, front and back sidewalls extending downwardly from the floor at the respective left, right, front and back edges with a plurality of sidewall through-holes being distributed along a length and extending through each sidewall of the left, right, front, and back sidewalls wherein the front edge of the first platform abutting the back edge of the second platform;

at least left and right L-brackets, each L-bracket of the left and right L-brackets including a first L-leg and a second L-leg orthogonal to the first L-leg, the second L-leg including a plurality of L-bracket through holes corresponding and aligning with at least some of the plurality of sidewall through holes;

a plurality of left and right side leg assemblies, each side leg assembly of the plurality of left and right side leg assemblies including (i) a side length-adjustable leg, (ii) a side footer received on a bottom end of the side length-adjustable leg, (iii) an angularly-adjustable mounting bracket received proximate a top end of the side length-adjustable leg; and first and second center leg assemblies, each center leg assembly of the first and second of center leg assemblies including (1) a center length-adjustable leg with top and bottom ends, and (2) a center footer received on the bottom end of the center length-adjustable leg;

wherein (a) the first and second center leg assemblies are received in the respective center receptacles of the first and second platforms, (b) the respective left sidewalls of the first and second platforms rest on the first L-leg of the left L-bracket, (c) the respective right sidewalls of the first and second platforms rest on the first L-leg of a first right L-bracket, (d) first, second and third left side leg assemblies of the plurality of left and right side leg assemblies are secured to the second L-leg of the first left L-bracket by way of the respective angularly-adjustable mounting brackets with the first and third left side leg assemblies being secured proximate the ends of the first left L-bracket and the second left side leg assembly being secured to the first left L-bracket proximate a center thereof adjacent to a location wherein the front edge of the first platform abuts the back edge of the second platform, and (e) first, second and third right side leg assemblies of the plurality of left and right side leg assemblies are secured to the second L-leg of the first right L-bracket by way of the respective angularly-adjustable mounting brackets with the first and third right side leg assemblies being secured proximate the ends of the first right L-bracket and the second right side leg assembly being secured to the first right L-bracket proximate a center thereof adjacent to a location wherein the front edge of the first platform abuts the back edge of the second platform.

2. The portable accessible ramp system of claim 1, wherein the plurality of left and right L-brackets are comprised of an aluminum alloy.

3. The portable accessible ramp system of claim 1, wherein the second L-leg of each L-bracket of the left and right L-brackets extends at 4" above the upper surface of the first and second platforms.

4. The portable accessible ramp system of claim 1, wherein the side length-adjustable leg comprises a pair of telescoping metal tubes.

5. The portable accessible ramp system of claim 1, wherein the center length-adjustable leg comprises a pair of telescoping metal tubes.

6. The portable accessible ramp system of claim 1, wherein the side footer is comprised of plastic and includes a side footer center receptacle wherein the bottom end of the side length-adjustable leg is received.

7. The portable accessible ramp system of claim 6, wherein the side footer center receptacle is a partially spherical indentation and the bottom end of the side length-adjustable leg is partially spherical and pivotally received in the side footer center receptacle.

8. The portable accessible ramp system of claim 7, wherein the side footer comprises a plurality of tapering radially-extending stringers that extend outwardly from the side footer receptacle to a perimeter of the side footer.

9. The portable accessible ramp system of claim 7, wherein the side footer further comprises a base plate portion with a substantially flat bottom surface, the base plate portion further including a plurality of bores extending through the base plate adapted to receive securing stakes therethrough.

10. The portable accessible ramp system of claim 1, further including at least second left and right L-brackets each cradling the second platform, at least fourth and fifth left side leg assemblies coupled to the second left L-bracket, at least fourth and fifth right side leg assemblies coupled to the second right L-bracket.

11. The portable accessible ramp system of claim 10, further including at least third left and right L-brackets each cradling the first platform, at least sixth and seventh left side leg assemblies coupled to the third left L-bracket, at least sixth and seventh right side leg assemblies coupled to the third right L-bracket.

12. The portable accessible ramp system of claim 1, wherein the first, second and third left and right side leg assemblies are secured to the respective first left and right L-brackets by way of threaded bolts that pass through the angularly-adjustable mounting brackets, the corresponding plurality of sidewall through holes and the corresponding plurality of L-bracket through holes.

* * * * *